US011326425B2

(12) United States Patent
Watson et al.

(10) Patent No.: US 11,326,425 B2
(45) Date of Patent: May 10, 2022

(54) PRESSURE PROTECTION SYSTEM FOR LIFT GAS INJECTION

(71) Applicant: Silverwell Technology Ltd., Histon (GB)

(72) Inventors: Peter John Watson, Rayleigh (GB); Joel David Shaw, Houston, TX (US)

(73) Assignee: SILVERWELL TECHNOLOGY LTD, Histon (GB)

( * ) Notice: Subject to any disclaimer, the term of this patent is extended or adjusted under 35 U.S.C. 154(b) by 240 days.

(21) Appl. No.: 16/821,814

(22) Filed: Mar. 17, 2020

(65) Prior Publication Data

US 2021/0293123 A1 Sep. 23, 2021

(51) Int. Cl.
*E21B 43/12* (2006.01)
*E21B 34/08* (2006.01)

(52) U.S. Cl.
CPC ..... *E21B 43/123* (2013.01); *E21B 34/08* (2013.01); *E21B 43/12* (2013.01)

(58) Field of Classification Search
CPC ..... E21B 43/12; E21B 43/123; E21B 34/08
See application file for complete search history.

(56) References Cited

U.S. PATENT DOCUMENTS 2,681,014 A 6/1954 Bryan
2,698,024 A * 12/1954 Canalizo ..... E21B 43/123 137/155
2,761,465 A * 9/1956 Garrett ..... E21B 43/123 137/155
3,131,644 A * 5/1964 Vincent ..... E21B 43/123 417/113
3,208,398 A 9/1965 Douglas
3,318,322 A 5/1967 Garrett
3,363,581 A * 1/1968 Kelley ..... E21B 43/123 417/117

(Continued)

FOREIGN PATENT DOCUMENTS

SU 848597 A1 7/1981

OTHER PUBLICATIONS

International Search Report and Written Opinion of PCT Application No. PCT/GB2021/050664 dated Jun. 16, 2021: pp. 1-14.

*Primary Examiner* — Matthew W Jellett
*Assistant Examiner* — Christopher D Ballman
(74) *Attorney, Agent, or Firm* — Bracewell LLP; Keith R. Derrington

(57) ABSTRACT

A lift gas injection system that is used for introducing lift gas into a stream of production fluid includes a lift gas injection valve. A pressure protection system guards the injection valve against external overpressure by blocking communication to inside the injection valve housing when ambient pressure exceeds a set pressure. Communication is blocked by moving a valve member so that it obstructs flow through an opening in the housing. The system includes pressure actuated valve which has a platen mounted to an end of a bellows, and a valve member coupled to the platen. Surface area is reduced on the bellows side of the platen that creates a force imbalance on the platen from applied ambient pressure. At the set pressure the force imbalance moves the platen, and which pushes the valve member against the opening. A compressible pressure compensator inside the injection valve protects against internal overpressure.

12 Claims, 7 Drawing Sheets

(56) References Cited

U.S. PATENT DOCUMENTS

| | | | | |
|---|---|---|---|---|
| 3,373,935 | A | 3/1968 | Thorburn | |
| 3,630,640 | A | 12/1971 | McMurry et al. | |
| 3,654,949 | A | 6/1972 | McMurry | |
| 3,851,997 | A * | 12/1974 | Douglas | E21B 43/123 417/112 |
| 4,026,110 | A | 5/1977 | Engstrom | |
| 4,151,857 | A | 5/1979 | DeMoss et al. | |
| 5,465,747 | A * | 11/1995 | de Almeida | E21B 43/123 137/155 |
| 6,364,640 | B1 * | 4/2002 | Nishio | F04B 9/125 417/540 |
| 8,413,726 | B2 * | 4/2013 | Stephenson | E21B 43/122 166/372 |
| 8,701,779 | B2 * | 4/2014 | Kleppa | F16K 41/10 166/326 |
| 9,010,353 | B2 | 4/2015 | Salihbegovic | |
| 9,267,363 | B2 * | 2/2016 | Hallundb | E21B 43/123 |
| 9,519,292 | B2 * | 12/2016 | Thorne | E21B 43/123 |
| 10,060,230 | B2 * | 8/2018 | Lopez | E21B 43/08 |
| 10,294,763 | B2 * | 5/2019 | Kleppa | F16J 3/06 |
| 10,480,284 | B2 | 11/2019 | Watson | |
| 10,711,571 | B2 * | 7/2020 | Woodford | E21B 34/14 |
| 2003/0111231 | A1 | 6/2003 | Faustinelli | |
| 2008/0283238 | A1 * | 11/2008 | Richards | E21B 43/12 166/228 |
| 2011/0067878 | A1 * | 3/2011 | Aadnoy | E21B 34/08 166/321 |
| 2012/0305243 | A1 * | 12/2012 | Hallundæk et al. | F16K 7/12 166/255.1 |
| 2014/0209822 | A1 * | 7/2014 | Mathiesen | F16K 31/002 251/11 |
| 2014/0262324 | A1 * | 9/2014 | Greci | E21B 34/10 166/374 |
| 2014/0338922 | A1 * | 11/2014 | Lopez | E21B 34/066 166/373 |
| 2015/0040990 | A1 * | 2/2015 | Mathiesen | E21B 34/08 137/12 |
| 2015/0047850 | A1 * | 2/2015 | Johnson | E21B 43/12 166/309 |
| 2015/0308239 | A1 * | 10/2015 | Langlais | E21B 43/12 166/278 |
| 2015/0330191 | A1 * | 11/2015 | Holderman | E21B 34/063 166/205 |
| 2016/0084049 | A1 * | 3/2016 | Vadasz | F16K 1/54 417/514 |
| 2016/0333655 | A1 * | 11/2016 | Fripp | E21B 29/02 |
| 2017/0254174 | A1 * | 9/2017 | Least | E21B 34/063 |

* cited by examiner

PRESSURE PROTECTION SYSTEM FOR LIFT GAS INJECTION

BACKGROUND OF THE INVENTION

1. Field of Invention

The present disclosure relates to a lift gas injection system having a pressure protection system.

2. Description of Prior Art

Hydrocarbons trapped in a subterranean formations are generally accessed and produced through wells drilled into the formations. The wells are usually lined with casing to form a barrier between the formation and well, and cement is injected around the casing to block communication between zones of different depths in the space around the casing. Production tubing is typically installed inside the casing, and which provides a conduit for directing produced fluids out of the well. Some formations have sufficient pressure to drive liquid and gas hydrocarbons to surface through the production tubing. For those formations with pressure insufficient to lift the liquids to surface, lift assistance is sometimes installed in the well. Lift assistance is often referred to as artificial lift; some common types of artificial are electrical submersible pumps, sucker rod pumping, gas lift, progressive cavity pumps, and plunger lift. Some wells in formations having sufficient pressure to drive liquids to surface at a point in time may subsequently undergo a loss in pressure, such as through depletion of hydrocarbons in the formation, and so that artificial lift will be required at later stages of the life of the well.

Gas lift systems generally operate by injecting amounts of lift gas downhole and into a stream of produced fluid flowing in the production tubing. The gas becomes dispersed within the stream of flowing fluid to give the fluid enough buoyancy to flow to surface on its own accord. The lift gas is sometimes obtained from surrounding wells, and commonly introduced into an annulus in the well formed between the production tubing and surrounding casing. Typically the lift gas enters the production tubing through injection valves that are disposed downhole in the annulus, and usually mounted onto an outer surface of the production tubing. Some injection valves operate based on a set pressure in the annulus, and others are equipped with electro-mechanical actuators that are controlled remotely. Some wells undergo testing that involves subjecting the annulus to high pressures, which sometimes exceeds a pressure rating or capacity of gas lift injection valves disposed in the annulus.

SUMMARY OF THE INVENTION

Disclosed herein is an example of a lift gas injection system for assisting lifting of fluids from a well, and which includes a lift gas injection valve disposed in an annulus in the well that is made up of a housing, a chamber in the housing having a portion in selective communication with production tubing that is in the well, an actuator in the housing, and a port formed through a sidewall of the housing between the chamber and having an inner end in communication with the chamber, and an outer end in selective communication with the annulus. Also included is a pressure protection system coupled with the lift gas injection valve and that is made up of a platen comprising an inner surface in pressure communication with the annulus, and an outer surface facing away from the inner surface that is in pressure communication with the annulus, an annular bellows having sidewalls, a space defined inside the sidewalls, an inner end, and an outer end coupled with a portion of the inner surface of the platen, so that an area of pressure communication with the annulus is less on the inner surface than on the outer surface. The annular bellows is moveable from an uncompressed configuration to a compressed configuration by a force exerted on the platen resulting from annulus pressure acting on the different areas of the inner and outer surfaces, and when annulus pressure reaches a set pressure. The system of this example also includes a valve assembly with a valve stem having an outer end coupled with the platen, and a valve member on an inner end of the valve stem, the valve member spaced away from the port when the bellows is in the uncompressed configuration, and in blocking contact with the port when the bellows is in the compressed configuration. The lift gas injection system optionally includes a spring in the space in the bellows. In an alternative, the system includes a compressible member in the chamber that is selectively changeable into a compressed configuration when pressure in the chamber exceeds a designated value, and which optionally includes a bellows, planar platens mounted on opposing ends of the bellows, a space inside the compressible member that is sealed from pressure communication with the chamber. The port of the lift gas injection valve alternatively includes an equalization portion, and in this example the lift gas injection valve further includes a flow inlet port that selectively receives a flow of lift gas from the annulus. The system optionally includes an outlet passage through which the flow inlet port is in fluid communication with the production tubing. The bellows and platen are optionally disposed inside the chamber, and the valve stem extends through the port. Alternatively, the bellows and platen are disposed inside the chamber, and the valve stem is a spring that extends through the port.

Another example of a lift gas injection system for assisting lifting of fluids from a well is provided herein and which includes a lift gas injection valve mounted to production tubing installed in the well, and which has a side port, and a passage through which lift gas in an annulus circumscribing the production tubing is communicated into the production tubing; and a pressure protection system coupled with the lift gas injection valve with a platen that receives a resultant force that varies with pressure in the annulus, a compressible member coupled with the surface of the platen and which is reconfigured into a compressed state when pressure in the annulus exceeds a set pressure, and a valve member that is selectively moved into blocking engagement with the side port when the compressible member is in the compressed state. In an example the platen has opposing surfaces that have larger and smaller areas in pressure communication with the annulus, and wherein simultaneously subjecting the opposing surfaces to pressure in the annulus generates opposing forces with different magnitudes that generates the resultant force. The compressible member optionally includes a bellows. In one example, a valve stem is mounted between the valve member and the platen. In an embodiment the compressible member and platen are disposed in a chamber inside the lift gas injection valve, and wherein a spring couples the valve member to the platen.

Also disclosed is a method of using a lift gas injection system for assisting lifting of fluids from a well, which includes injecting lift gas into production tubing installed in the well from an annulus that circumscribes the production tubing and through a lift gas injection valve, exerting an opening force onto a valve assembly to maintain pressure communication between the annulus and a port on the lift gas injection valve, applying a closing force onto the valve assembly to counter the opening force, the closing force generated by application of pressure in the annulus to a member having opposing sides having areas of different size in communication with the annulus, the member being strategically sized so that when the pressure in the annulus exceeds a set pressure, the closing force exceeds the opening force. In an example, the opening force is generated by an annular bellows that is coupled to the valve assembly. The member can be a planar platen, wherein the closing force is generated by a pressure protection system that includes the platen, and wherein the platen is attached to an outer end of the bellows. In an example, the bellows urges the valve assembly away from the port when the pressure in the annulus drops below the set pressure.

BRIEF DESCRIPTION OF DRAWINGS

Some of the features and benefits of the present invention having been stated, others will become apparent as the description proceeds when taken in conjunction with the accompanying drawings, in which.

Figure 1:
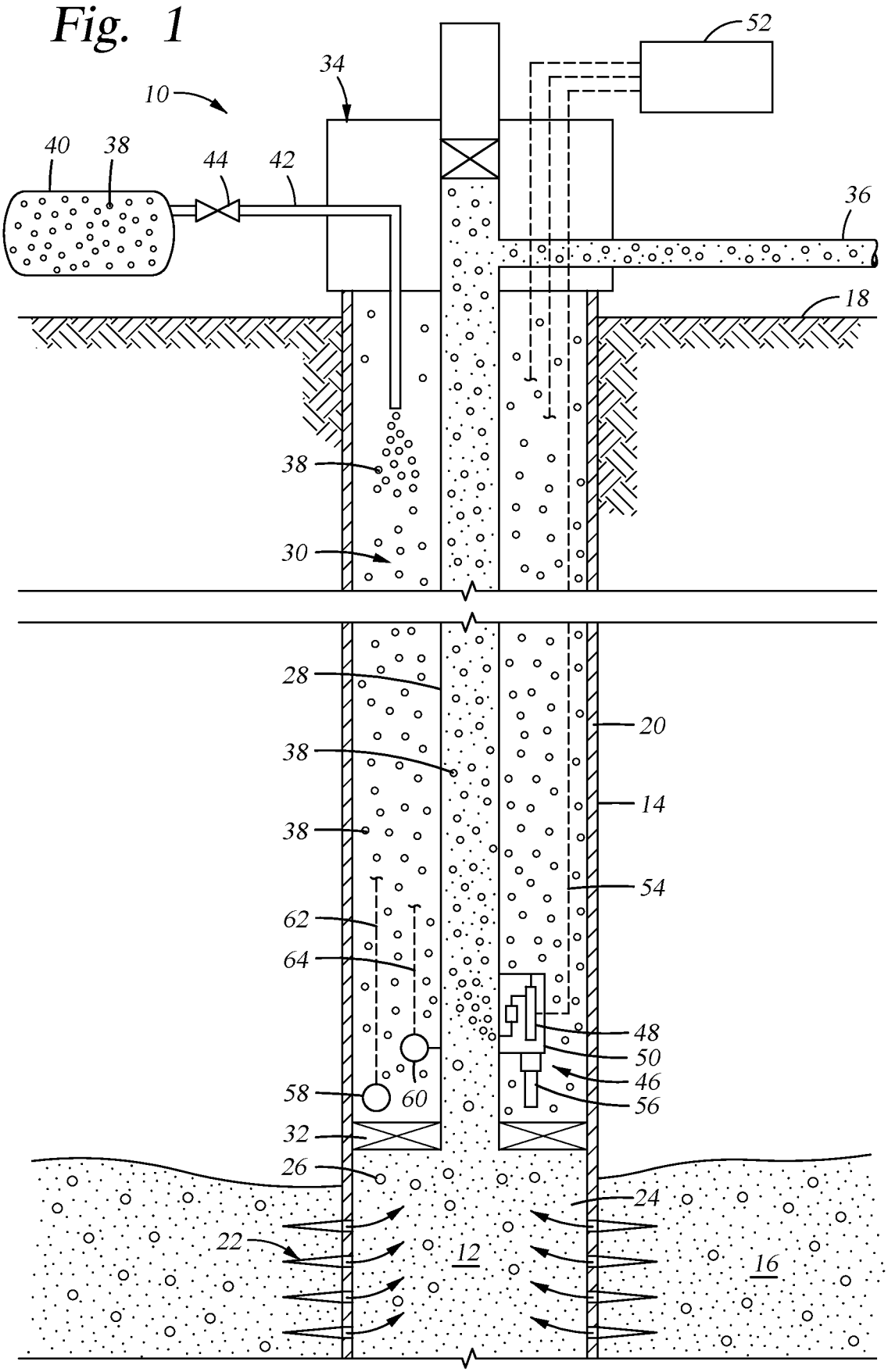
FIG. 1 is a side partial sectional view of an example of a lift gas injection system for use with a hydrocarbon producing wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, the terms "about" and "substantially" include +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a side partial sectional view of an example of a lift gas injection system 10 and which is used for assisting the lifting of fluid 12 from within a wellbore 14. As shown, the fluid 12 is produced from a formation 16 that surrounds the wellbore 14, and subsequently is transported to a surface 18. Casing 20 lines the wellbore 14 of FIG. 1 and provides a barrier between formation 16 and wellbore 14. Cement (not shown) is optionally disposed on the outer surface of casing 20 seals communication between zones of different depths in the formation 16. Perforations 22 are shown that extend radially outward from wellbore 14 into formation 16 and which provide a pathway for the fluid 12 to enter into wellbore 14. In the example of FIG. 1, the fluid 12 includes an amount of liquid 24 and gas 26 (shown as bubbles within the liquid 24). Alternate embodiments exist where the fluid 12 is made up wholly or substantially of liquid. After exiting the perforations 22, the fluid 12 is directed uphole within production tubing 28 shown installed within the casing 20. An annulus 30 is formed between the production tubing 28 and casing 20, and a packer 32 is shown installed in the annulus 30, and which prevents the flow of the fluid 12 upwards within annulus 30. An upper end of the production tubing 28 is shown coupled with a wellhead assembly 34 on surface 18 and a production line 36 attaches with an upper end of production tubing 28 and so the flow of fluid 12 is transported from well 14 through production line 36.

In FIG. 1 lift gas 38 is shown being introduced into the production tubing 28, and which when dispersed within the fluid 12 reduces the density of the fluid 12. Buoyancy of the fluid 12 is increased with the reduced density which facilitates flow of the fluid 12 up the production tubing 28. The lift gas 38 is from a lift gas supply 40 shown on surface 18, a lift gas supply line 42 connects to the lift gas supply 40 and provides an example conduit for delivering the lift gas 38 into the annulus 30. A lift gas supply valve 44 is installed in the gas supply line 42 for selectively providing communication between the lift gas supply 40 and annulus 30. Examples of lift gas supply 40 include surrounding wells, gas transmission lines, and pressurized vessels. Lift gas 38 enters into the production tubing 28 from the annulus 30 through a lift gas injection valve 46 shown disposed within the annulus 30 and coupled with an outer surface of the production tubing 28. In the example illustrated, the lift gas injection valve 46 includes an actuator assembly 48 (shown in dashed outline), which in an alternative is selectively energized or deenergized to open/close the lift gas injection valve 46 to allow fluid flow through the valve 46. Actuator assembly 48 is shown set within a housing 50, which in an example withstands greater pressures than the actuator assembly 48 without becoming damaged. In one embodiment, the housing 50 provides pressure protection to the actuator assembly 48.

Still referring to the example of FIG. 1, a controller 52 is shown outside of the well 14 and in signal communication with the lift gas injection valve 46 via a signal line 54. Examples of signal line 54 include electrically conductive wire, fiber optic lines, and wireless transmission. A pressure protection system 56 is included with the lift gas injection valve 46, and which selectively blocks pressure communication through the housing 50 within lift gas injection valve 46. In a non-limiting example of operation, the communication is blocked when pressure within annulus 30 reaches a designated pressure. In one example a value of the designated pressure is based on pressure ratings of components within the lift gas injection valve 46 (i.e. pressures at which the components will not sustain damage and remain functional). Embodiments exist where designated pressures differ due to different operating scenarios or philosophies employed to determine what are acceptable pressures for operating components downhole. It is believed it is within the capabilities of those skilled to obtain or estimate a value for a designated pressure. Further illustrated in the example of FIG. 1 are sensors 58, 60 that respectively sense pressure within the annulus 38 and inside production tubing 28. Signal lines 62, 64 connect respectively to sensors 58, 60 and provide communication between sensors 58, 60 and controller 52.

Figure 2:
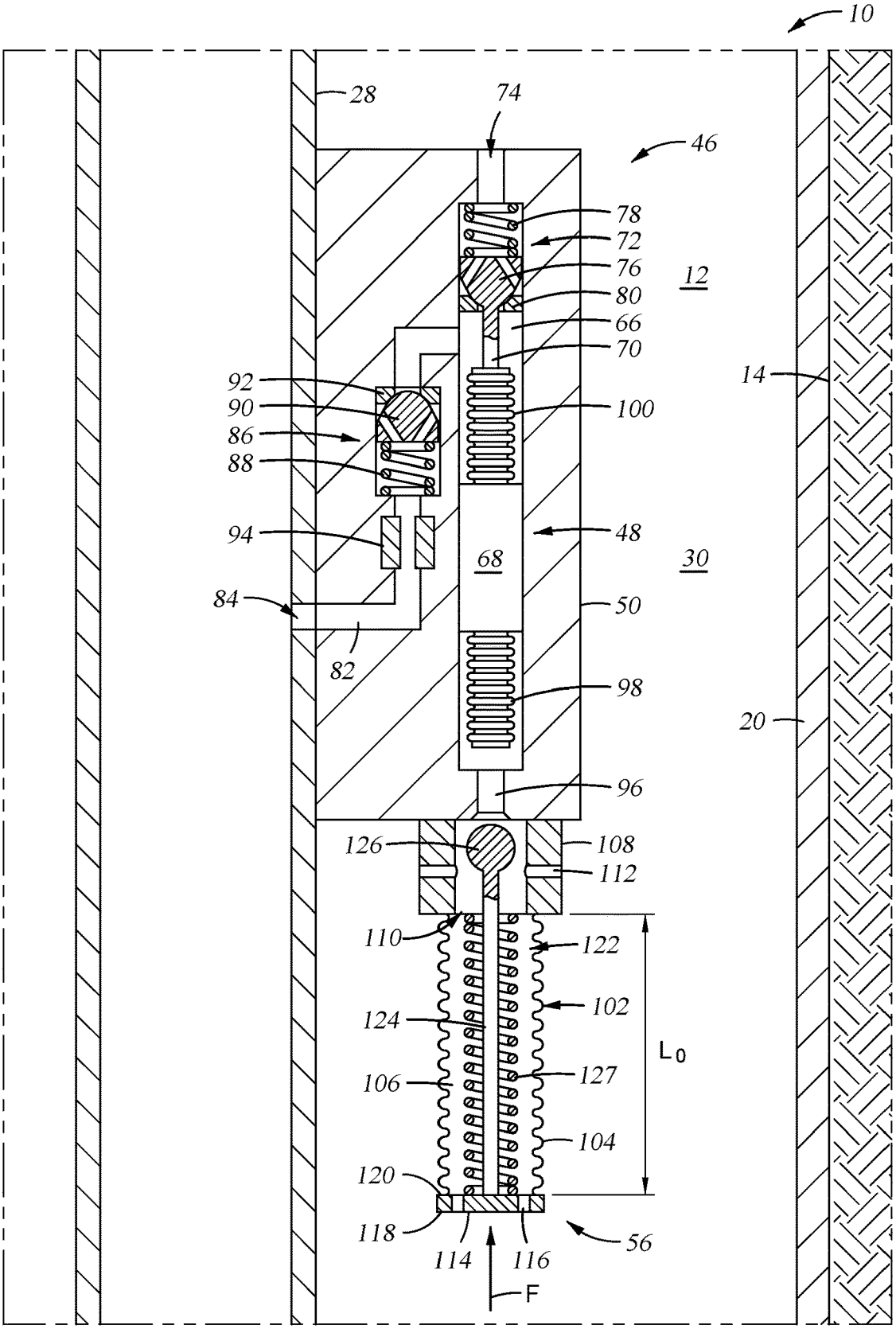
FIG. 2 is a side partial sectional view of an example of a pressure protection system coupled to a lift gas injection valve that is for use with the lift gas injection system of FIG. 1.

Referring now to FIG. 2, shown in a side sectional view is an example of the lift gas injection valve 46 and pressure protection system 56. In the example of FIG. 2, a chamber 66 is formed within the housing 50 of the lift gas injection valve 46; and which provides a space in which actuator 48 is located. The example actuator assembly 48 includes an actuator motor 68 shown coupled with an elongated rod 70, and a check valve assembly 72 disposed in a portion of chamber 66 adjacent the actuator 48. In the example of FIG. 2, check valve assembly 72 is shown in a closed configuration and which blocks communication between a flow inlet port 74 shown intersecting an outer surface of housing 50. Check valve assembly 72 of FIG. 2 includes a ball member 76 and a spring 78 shown on a side of ball 76 opposite from rod 70. The spring 78 biases ball 76 into sealing engagement with a ball seat 80 that is mounted within chamber 66. The check valve assembly 72 is in a closed configuration when the ball 76 is biased against the ball seat 80. In one non-limiting example of operation, the check valve assembly 72 is put into an open configuration by energizing motor 68 to urge rod 70 axially away from motor 68, that in turn pushes ball 76 out of engagement with ball seat 80. When the check valve assembly 72 is in the open configuration, flow inlet port 74 communicates to inside of chamber 66, and which allows fluid 12 within annulus 30 to make its way to the inside of housing 50. One example of actuator assembly 48 is found in Watson, U.S. Pat. No. 10,480,284 ("Watson '284"); which is assigned to the owner of the present application. Watson '284 is incorporated by reference herein in its entirety and for all purposes.

An outlet passage 82 is shown formed through housing 50 that extends from chamber 66 and to an outer surface of housing 50 adjacent the tubing 28. An opening 84 is formed radially through a sidewall of tubing 28 and which registers with outlet passage 82. In an example of operation of the embodiment of FIG. 2, opening the check valve assembly 72 provides communication from annulus 30, through the lift gas injection valve 46, and into production tubing 28. An optional check valve assembly 86 is shown within outlet passage 82, and which an example, blocks flow from within production tubing 28 back into chamber 66. The check valve assembly 86 includes a spring 88 within passage 82 that applies a force against a ball 90 to urge ball 90 into a seat 92. Further optionally, an orifice 94 is shown within outlet passage 82 which is defined by a region of passage 82 having a lower cross-sectional area, and which restricts a portion of the outlet passage 82. A pressure equalizing port 96 is shown formed through housing 50 and terminating in chamber 66. As explained in Watson '284, pressure within annulus 30 is communicated to chamber 66 through equalizing port 96 to equalize pressures applied to opposing surfaces of components in the actuator 48. Equalizing the pressures reduces forces necessary for exerting rod 70 against ball 76. Bellows 98, 100 are shown in the example of FIG. 2 that also lessen forces necessary for operation of the lift gas injection valve 46.

Still referring to FIG. 2, included with the pressure protection system 56 is an annular bellows 102 which has a sidewall 104 equipped with undulations or pleats. In an embodiment, the configuration of the sidewall 104 allows axial deformation of the bellows 102 without it being deformed. In an example, the material of the sidewall 104 is elastic, so that axially compressing bellows 102 stores in it a spring force, so that the bellows 102 returns to its uncompressed configuration when the compressive force is removed. A space 106 is defined within the sidewalls 104, and an end of the sidewalls 104 mounts onto a base 108 shown coupled to a lateral side of housing 50. A bore 110 extends axially through base 108, and base 108 mounts to housing so that bore 110 and pressure equalizing port 96 are in registration with one another. Further, the bellows 102 mount onto base 108 so that space 106 is in communication with bore 110. Side ports 112 extend radially through base 108 and which provide communication between the annulus 30 and bore 110. An outer end of the bellows 102 attaches to a planar disc-like platen 114 shown having openings 116 that extend axially through the platen 114. Communication between space 106 and annulus 30 is provided through openings 116. An outer surface 118 of platen 114 faces away from space 106 and an inner surface 120 of platen 114 faces toward space 106. As will be discussed in more detail below, both surfaces of the inner and outer surfaces 118, 120 are in pressure communication with annulus 30. In the example of FIG. 2, a portion of the surface area of the inner surface 120 is occupied by the outer end of bellows 102, which reduces the surface area of the inner surface 120 that is in communication with the annulus 30. In the embodiment of FIG. 2, outer surface 118 is not coupled with other objects, and as illustrated has a surface area in communication with annulus 30 that exceeds the portion of inner surface 120 in communication with annulus 30. In the illustrated example, a resultant force F is depicted that is exerted on platen 14 in the direction shown, and which is generated by pressure within annulus 30. In the illustrated example, force F increases as pressure in annulus 30 increases. The example of the pressure protection system 56 of FIG. 2 also includes a pressure valve 122 shown made up of an elongated valve stem 124 having an outer end attached to the inner surface 120 of platen 114. An inner end of the valve stem 124 has a valve member 126 attached thereto. The example of the valve member 126 shown is spherical, and alternate configurations of the valve member 126 exist that include shapes that are disc-like, elliptical, and obloid. In the configuration of FIG. 2, the bellows 102 is in an uncompressed state and having a length $L_O$, and the valve member 126 is shown spaced away from the pressure equalizing port 96 and does not impede pressure communication between port 96 and the annulus 30. Optionally included with the embodiment of FIG. 2 is a spring 127 shown as a helical member and disposed generally coaxial within the bellows 102 and circumscribing valve stem 124. As described in more detail below, examples exist where spring 127 resists axial compression of bellows 102 and assists with returning the bellows 102 to an uncompressed state from a compressed state.

As noted above, examples of operating the lift gas injection valve 46 exist in which a designated pressure has been established, and a corresponding set pressure determined at which the pressure protection system 56 operates to suspend pressure communication between the chamber 66 and annulus 30. Embodiments exist where the set pressure matches the designated pressure, is less than the designated pressure, and greater than the designated pressure. It is within the capabilities of those skilled to determine a set pressure, and also within the capabilities of those skilled to form a pressure protection system that operates at a particular set pressure.

Figure 3:
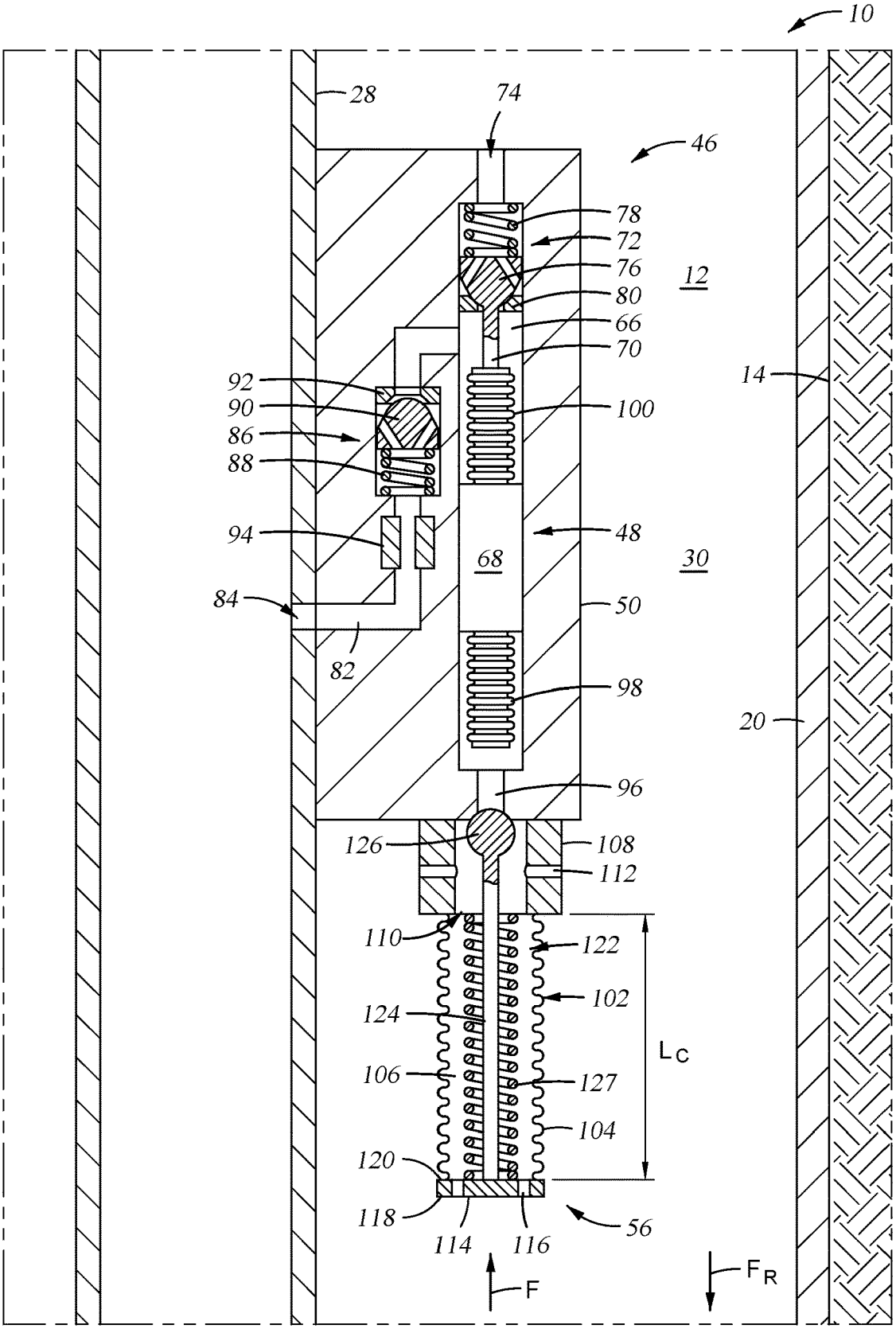
FIG. 3 is a side partial sectional view of the pressure protection system of FIG. 2 blocking communication of ambient pressure into inside the lift gas injection valve.

Referring now to FIG. 3, shown is an example when pressure in the annulus 30 in at or exceeds a set pressure, which initiates operation of the pressure protection system 56. As schematically represented, a pressure differential created by the different surface areas of the outer and inner surfaces 118, 120 generates force F. Further in this example forced F is greater than a resistive force $F_R$ within bellows 102 and presses the bellows 102 to a compressed configuration and having a compressed length $L_C$. Reducing the length of the bellows 102 to the compressed length $L_C$ urges the platen 114 and attached valve stem 124 towards the base 108. Moving the valve stem 124 a sufficient distance moves the valve member 126 into engagement with the pressure equalizing port 96 and which forms a barrier between chamber 66 and annulus 30. In an alternate example of operation, when pressure in annulus 30 drops below that of a set pressure, the resistive force $F_R$ alone overcomes the force F created by the pressure differential across platen 114 and urges the bellows 102 back to their uncompressed configuration of FIG. 2 and having a length $L_O$. Optionally, inclusion of spring 127 (FIG. 2) assists the bellows 102 in expanding back to the uncompressed configuration.

Figure 4:
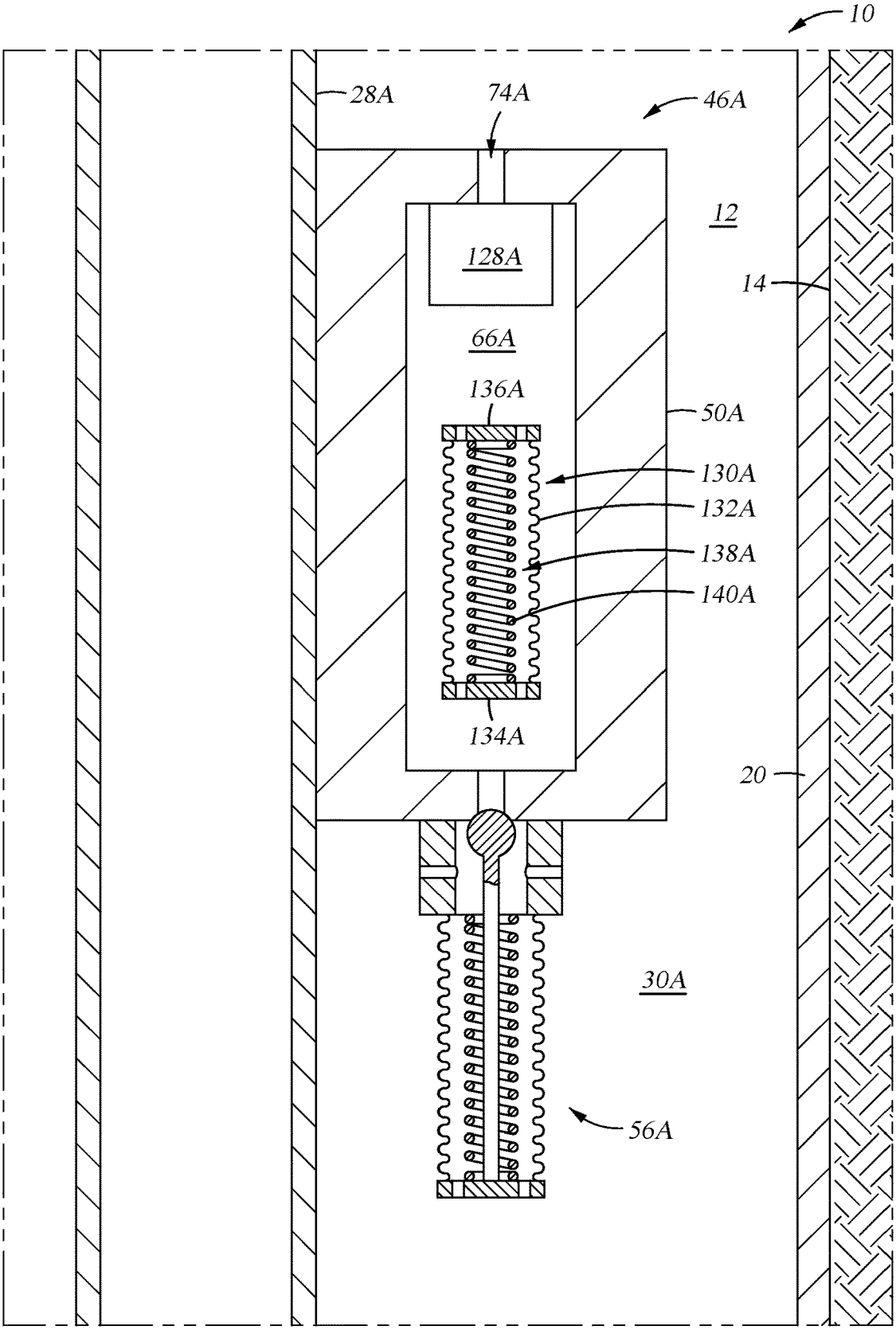
FIG. 4 is a side partial sectional view of an alternate embodiment of the lift gas injection valve, and which includes an example of a pressure protection system and an example of a temperature protection system.

An alternate example of the lift gas injection valve 46A is shown in a side sectional view in FIG. 4, and which includes a protected device 128A shown in chamber 66A. Examples of the protected device 128A include components or devices that are selectively isolated from pressure in the annulus 30 to prevent being damaged. One example of a protected device 128A is the actuator assembly 48 of FIG. 2. Further illustrated in FIG. 4 is a temperature compensator 130A in the chamber 66A. In an example, temperature compensator 130A is a selectively compressible member and that the event chamber 66A experiences pressurization the temperature compensator 130A experiences a reduction in volume to relive pressure in the remaining sections of chamber 66A. In a non-limiting example, chamber 66A experiences pressurization when the chamber 66A is sealed and fluid becomes trapped within; and a temperature inside the chamber 66A increases after sealing the fluid, which causes thermal expansion of the fluid trapped within. In this example, the temperature compensator 130A reduces in volume to offset expansion of the trapped fluid. In the example of FIG. 4, the temperature compensator 130A includes an annular bellows 132A that is capped at its opposing ends by a pair of planar platens 134A, 136A. The combination of the bellows 132A and platens 134A, 136A define a space 138A within the temperature compensator 130A. Within space 138A of FIG. 4, a spring 140A is shown and which in an example of operation, serves to resist the compression that occurs in some examples of pressurization of chamber 66A, and alternatively expands the temperature compensator 130A to an uncompressed state when pressure within chamber 66A is reduced below a threshold value. Similar to the designated pressure that is used in some examples to obtain a set pressure, a designated value of pressure within chamber 66A is used to design the temperature compensator 130A.

Figure 5:
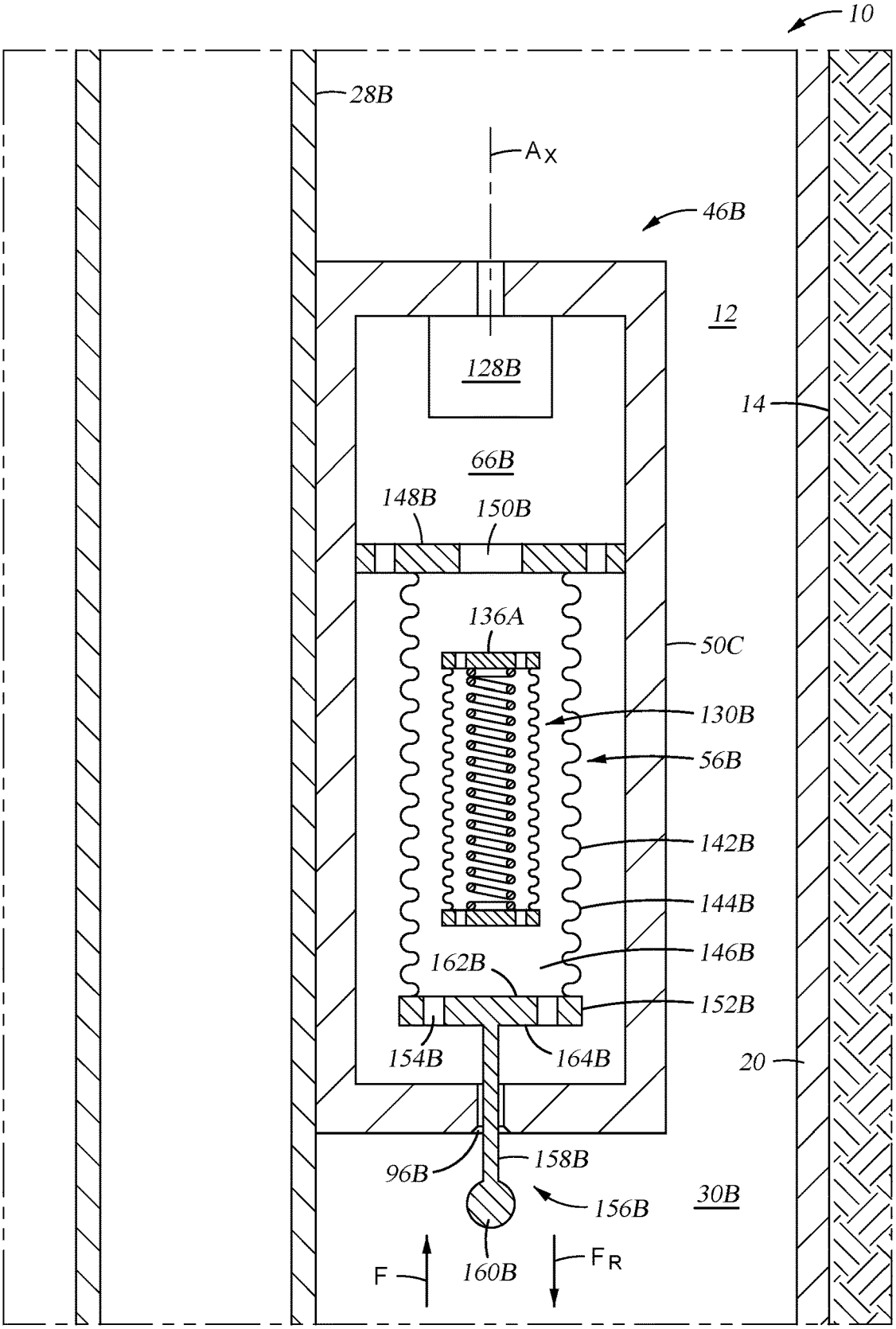
FIG. 5 is a side partial sectional view of an alternate example of a pressure protection system mounted onto an alternate example of the lift gas injection valve.

Shown in FIG. 5 is another alternate embodiment of the lift gas injection valve 46B. Also in FIG. 5 is an alternate example of the pressure protection system 56B disposed within chamber 66B. An annular bellows 142B is included in the pressure protection system 56B and which includes a wall 144B shown having an undulating cross-section. Space 146B is formed within the walls 144B and a base platen 148B mounts to a lower end of the bellows 142B. In the illustrated example of FIG. 5, the base platen 148B is a planar member and has an outer circumference coupled with an outer surface of the chamber 66B. End ports 150B are shown extending axially through base platen 148B and that provide communication between chamber 66B and the space 146B. A floating platen 152B is shown in the example of FIG. 5 mounted on an end of bellows 142B opposite from the base platen 148B and openings 154B extend axially through the floating platen 152B. A pressure valve 156B is shown coupled with the floating platen and which includes an elongated valve stem 158B having one end attached to floating platen 152B and a distal end with a valve member 160B mounted thereon. An inner surface 162B of the floating platen 152B faces inward towards space 146B and an outer surface 164B of platen 152B faces away from the space 146B. In one example of operation, pressure protection system 56B operates similar to that of FIG. 2, and pressure communicating into chamber 66B from the annulus 30B creates a resultant force $F_R$ urging the platen 152B towards base platen 148B that in turn draws the valve stem 158B and attached valve member 160B into sealing contact with the pressure equalizing port 96B. Optionally, a temperature compensator 130B is disposed within space 146B, and which in an example compensates for an increase in pressure within chamber 66B. In an alternative, the temperature compensator 130B is disposed in chamber 66B and outside of space 146B. In an alternative, platens 148B, 152B are substantially solid and without ports 150B, 154B, and space 146B is isolated from chamber 66B. In another alternative, system 56B has walls 144B that are disposed a constant radial distance from an axis $A_X$ of housing 50B, and are not undulating or bellows like.

Figure 6:
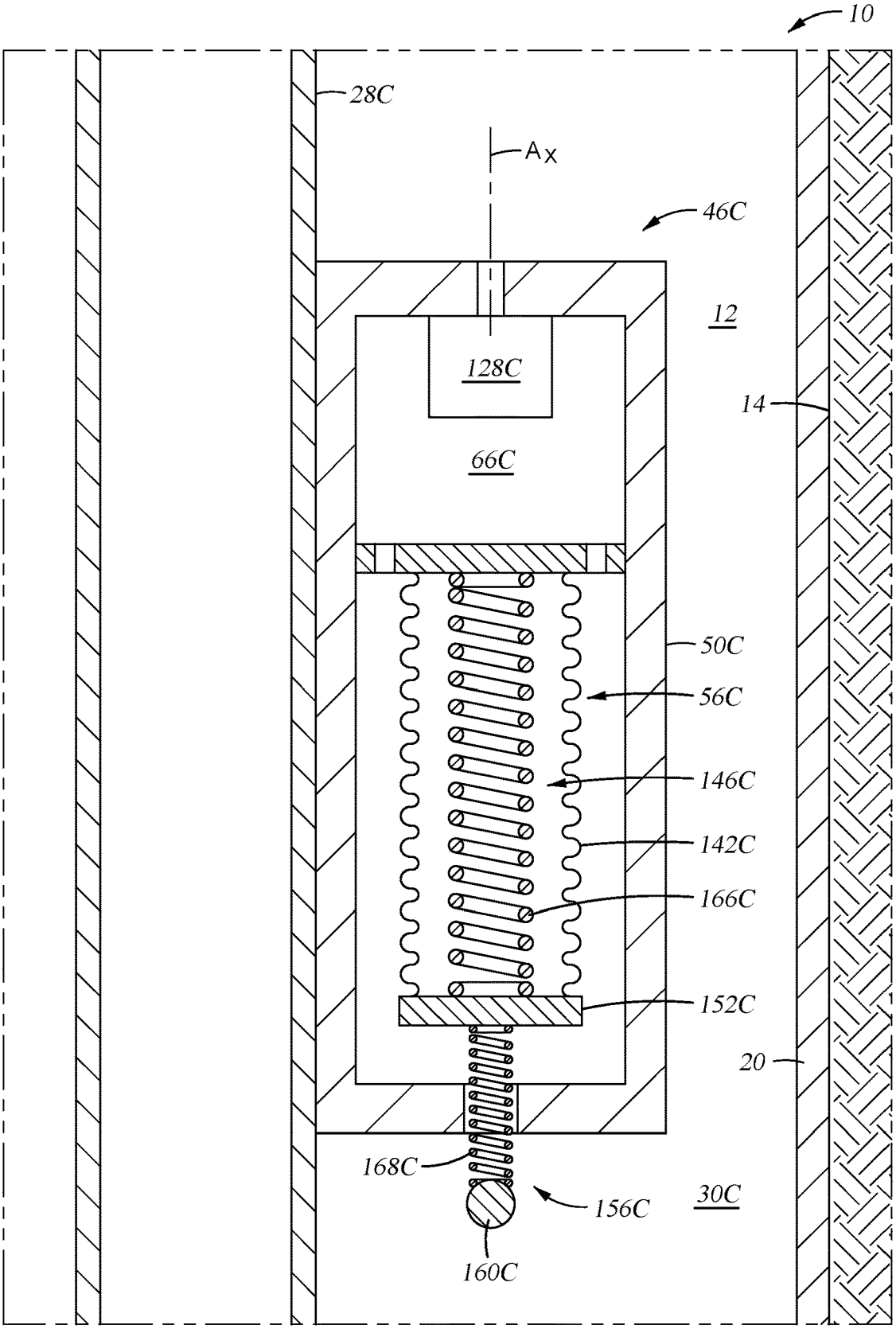
FIG. 6 is a side partial sectional view of another alternate example of a pressure protection system included with a lift gas injection valve.

Another alternative example of the lift gas injection valve 46C is shown in a side sectional view in FIG. 6. In this example, bellows 142C is shown disposed within chamber 66C and with a floating platen 152C which is substantially solid and without ports extending therethrough. Further optionally, a spring 166C is disposed within bellows 142C and which provides a greater resistive force for resisting the force from the pressure differential across floating platen 152C. Further in the example of FIG. 6, the floating platen 152C attaches to valve member 160C via a spring 168C that extends between these two members. Further illustrated in this examples is that base platen 148C is also substantially solid, the bellows 142C and solid platens 148C, 152C isolate space 146C from chamber 66C. The pressure protection system 56C with the sealed space 146C operates as a thermal compensation system similar to thermal compensation system 130A of FIG. 4, and experiences a reduction in volume to counter thermal expansion of fluid trapped inside housing 50C. In an example, pressure protection system 56C provides protection against overpressure due to increases in temperature experienced within housing 50C.

Figure 7:
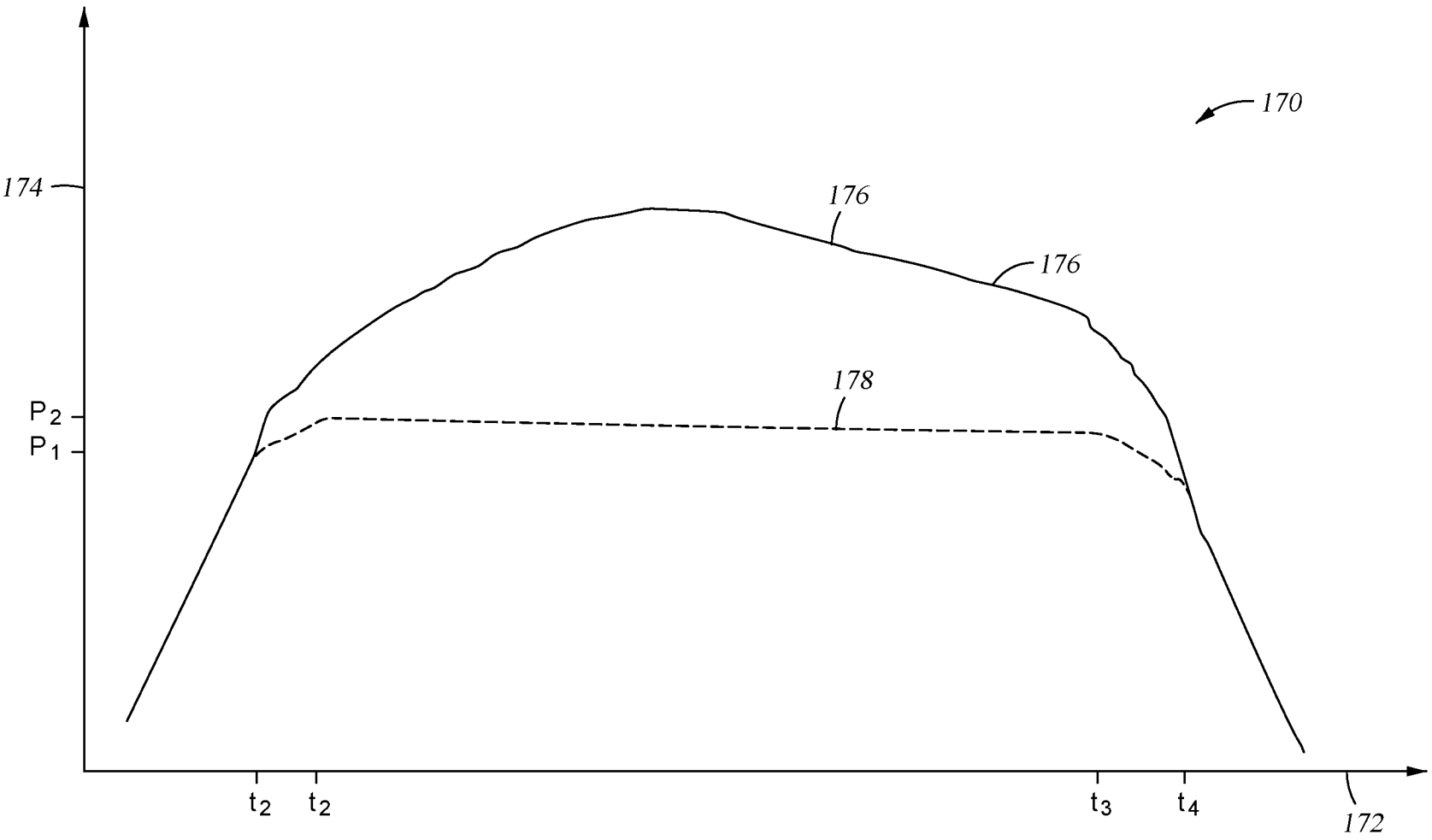
FIG. 7 is a graphical representation of an example of pressure over time inside and outside of a lift gas injection valve equipped with a pressure protection system.

A graph 170 is shown in the example of FIG. 7 having coordinate axis with an abscissa 172 representing time and an ordinate 174 representing pressure. A time plot of pressure 176 reflects the pressure within annulus 30 of FIG. 2 that takes place during a pressure excursion. Examples of a pressure excursion include a pressure above that which would be typically experienced during a lift gas injection operation, or a pressure above typical well operation. Additional examples of a pressure excursion includes a pressure or pressures during a pressure test, a packer test, fracing, a tubing test, and the like. Also shown in a dotted outline is a time plot of pressure 178 that in one example occurs during the excursion shown in time plot 176, but which occurs within chamber 66 of the housing 50. As shown, at around time $t_1$ the set pressure in the annulus 30 is reached and the pressure relieving system 56 commences its operation. At time $t_2$ communication between chamber 66 and annulus 30 is blocked. In the time span between time $t_1$ and time $t_2$ pressure within the chamber 66 rises an amount from $P_1$ to $P_2$, but remains substantially at $P_2$ while communication between chamber 66 and annulus 30 is blocked. The time span between time $t_3$ and time $t_4$ in this example represents when pressure in the annulus 30 drops to and below the designated pressure and the pressure protection system 56 retracts from blocking communication between the chamber 66 and annulus 30, and pressure in chamber 66 drops from $P_2$ to $P_1$. In an example, the pressure in annulus 30 is the same or different than the set pressure.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A lift gas injection system for assisting lifting of fluids from a well, the system comprising:

a lift gas injection valve disposed in an annulus in the well, and that comprises, a housing, a chamber in the housing having a portion in selective communication with production tubing that is in the well, an actuator in the housing, and a port formed through a sidewall of the housing between the chamber and having an inner end in communication with the chamber, and an outer end in selective communication with the annulus; and a pressure protection system coupled with the lift gas injection valve and that comprises a platen comprising an inner surface in pressure communication with the annulus, and an outer surface facing away from the inner surface that is in pressure communication with the annulus, an annular bellows that comprises sidewalls, a space defined inside the sidewalls, an inner end, and an outer end coupled with a portion of the inner surface of the platen, so that an area of pressure communication with the annulus is less on the inner surface than on the outer surface, the annular bellows moveable from an uncompressed configuration to a compressed configuration by a force exerted on the platen resulting from annulus pressure acting on the different areas of the inner and outer surfaces, and when annulus pressure reaches a set pressure, a valve assembly comprising a valve stem having an outer end coupled with the platen, and a valve member on an inner end of the valve stem, the valve member spaced away from the port when the bellows is in the uncompressed configuration, and in blocking contact with the port when the bellows is in the compressed configuration.

2. The lift gas injection system of claim 1, further comprising a spring in the space in the bellows.

3. The lift gas injection system of claim 1, further comprising a compressible member in communication with the chamber that is selectively changeable into a compressed configuration when pressure in the chamber exceeds a designated value.

4. The lift gas injection system of claim 3, wherein the compressible member comprises a bellows, planar platens mounted on opposing ends of the bellows, a space inside the compressible member that is sealed from pressure communication with the chamber.

5. The lift gas injection system of claim 1, wherein the port of the lift gas injection valve comprises an equalization portion, the lift gas injection valve further comprising a flow inlet port that selectively receives a flow of lift gas from the annulus.

6. The lift gas injection system of claim 5 further comprising, an outlet passage through which the flow inlet port is in fluid communication with the production tubing.

7. The lift gas injection system of claim 1, wherein the bellows and platen are disposed inside the chamber, and the valve stem extends through the port.

8. The lift gas injection system of claim 1, wherein the bellows and platen are disposed inside the chamber, and the valve stem comprises a spring that extends through the port.

9. A lift gas injection system for assisting lifting of fluids from a well, the system comprising:

a lift gas injection valve mounted to production tubing installed in the well, and that comprises a side port, and a passage through which lift gas in an annulus circumscribing the production tubing is communicated into the production tubing; and a pressure protection system coupled with the lift gas injection valve that comprises a platen that receives a resultant force that varies with pressure in the annulus, a compressible member coupled with the surface of the platen and which is reconfigured into a compressed state when pressure in the annulus exceeds a set pressure, and a valve member that is selectively moved into blocking engagement with the side port when the compressible member is in the compressed state, the platen comprising opposing surfaces that have larger and smaller areas in pressure communication with the annulus, and wherein simultaneously subjecting the opposing surfaces to pressure in the annulus generates opposing forces with different magnitudes that generates the resultant force.

10. The lift gas injection system of claim 9, wherein the compressible member comprises a bellows.

11. The lift gas injection system of claim 9, further comprising a valve stem mounted between the valve member and the platen.

12. The lift gas injection system of claim 9, wherein the compressible member and platen are disposed in a chamber inside the lift gas injection valve, and wherein a spring couples the valve member to the platen.

* * * * *